United States Patent [19]

Latimer

[11] 4,433,513

[45] Feb. 28, 1984

[54] STORAGE AND SHIPPING UNIT

[76] Inventor: William A. Latimer, 2523 Meadow La., Topeka, Kans. 66614

[21] Appl. No.: 408,023

[22] Filed: Aug. 13, 1982

[51] Int. Cl.[3] ..... A47B 5/00

[52] U.S. Cl. ..... 52/36; 52/125.2; 62/465; 211/133

[58] Field of Search ..... 62/440, 451, 457, 465; 52/79.1, 125.2, 125.4, 745; 108/51.1; 211/126, 128, 133, 207, 208

[56] References Cited

U.S. PATENT DOCUMENTS

| | | | |
|---|---|---|---|
| 2,370,267 | 2/1945 | Starr | 62/440 X |
| 2,621,486 | 12/1952 | Morrison | 62/440 X |
| 2,877,508 | 3/1959 | Ewart | 52/125.2 |
| 3,123,186 | 3/1964 | Adkinson, Jr. et al. | 52/125.2 X |
| 3,470,705 | 10/1969 | Hall | 62/440 X |
| 3,494,535 | 2/1970 | Acker | 108/55.1 X |
| 3,961,925 | 6/1976 | Rhoad | 62/457 X |

FOREIGN PATENT DOCUMENTS

| | | | |
|---|---|---|---|
| 672538 | 5/1972 | United Kingdom | 211/133 |

*Primary Examiner*—William E. Tapolcai

*Attorney, Agent, or Firm*—Schmidt, Johnson, Hovey & Williams

[57] ABSTRACT

A walk-in container for shipping or storage of goods, or housing of equipment, has an optional, built-in refrigeration system for cooling perishable products, together with an internal rack for suspending, by hooks and loops, a multitude of open-top, wire-work baskets for the articles to be loaded therein. The rack includes a plurality of uprights removably connected to an upper and a lower framework functioning also as structural components of the container shell. Handling is facilitated by provision of an underlying pallet, also reinforcing the shell by connection with the lower framework, and by lifting eyelets atop the container for raising and lowering the pallet and the container supported thereby.

10 Claims, 13 Drawing Figures

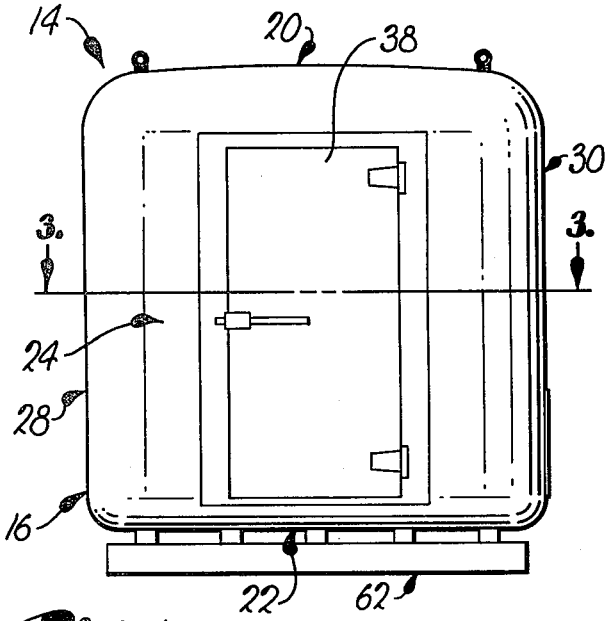
Fig. 1.
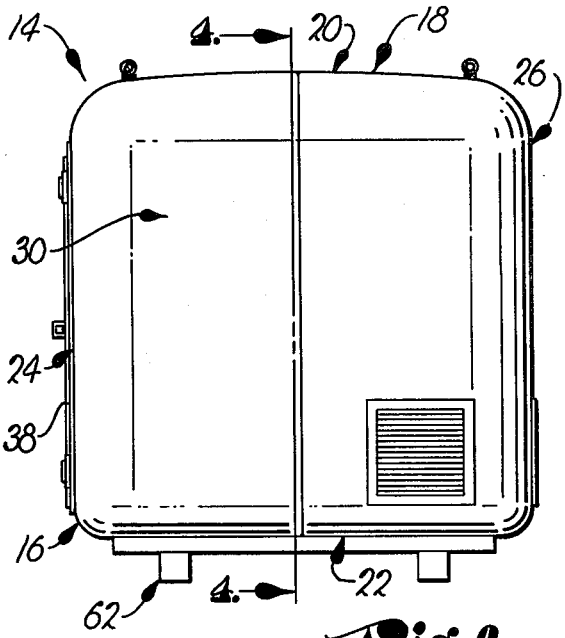
Fig. 2.
Fig. 3.
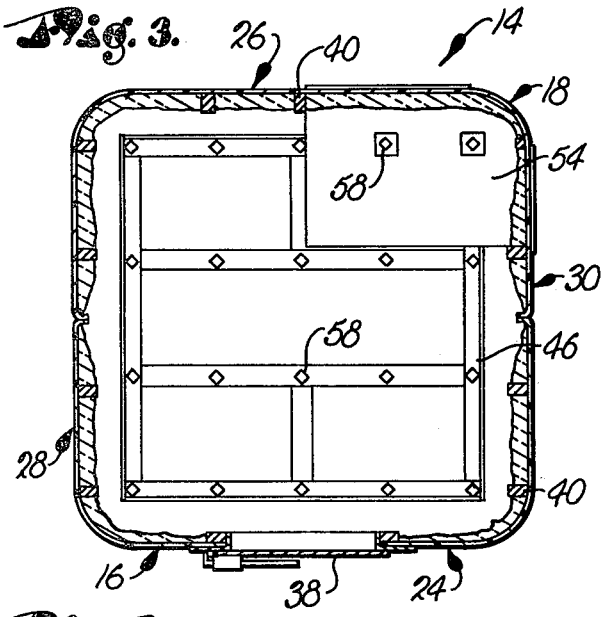
Fig. 4.
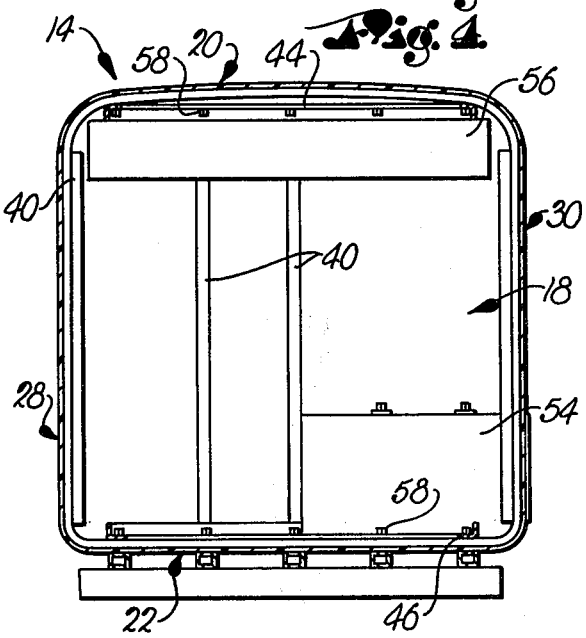
Fig. 5.
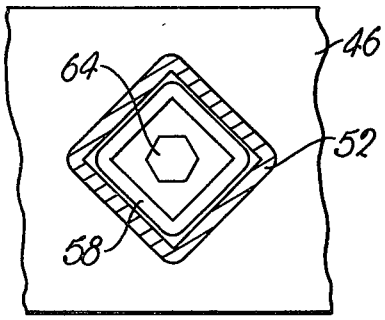
Fig. 6.
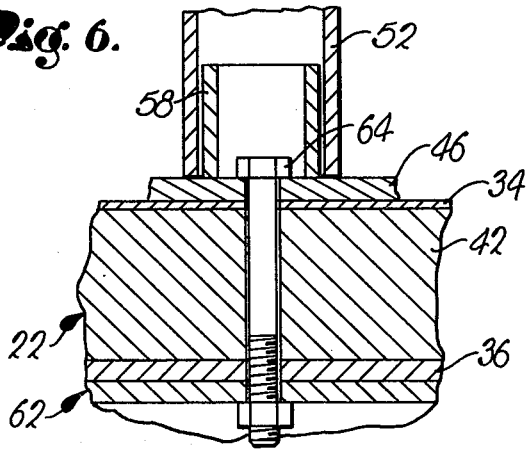

STORAGE AND SHIPPING UNIT

My present invention relates in the first instance to the storage and/or shipment of produce, such as fresh fruit and vegetables, from country to country or, for example, from islands and other temperate zones where handling during harvest and preservation thereafter have heretofore presented some difficult problems. It does, however, have application to other agricultural products, and is not limited to foods or ingredients of foods; multitudes of articles may be handled through use of my improvements. The novel container made according to my concepts need not always be transported by navigation on the water nor be used solely as a shipping container; nor is its use limited to conveyance abroad beyond the boundaries of a given country or island.

Accordingly, the container may be described, for certain applications and uses, as a transportable walk-in cooler containing a multiplicity of receptacles for the goods to be loaded therein, e.g. open-top, wire-work baskets, and equipped with a mechanical refrigeration system. Through use of releasable hooks and loops, the baskets are kept spaced by four-point suspension from rows of tubular uprights, most of which are, in turn, removable.

All structural components, including the uprights, are enclosed within a sectional, insulated shell having an access door, the supports for the baskets also constituting the framework forming the structural support for the shell. A special corner strengthening arrangement is provided in association with an underlying pallet and a top eyelet handling feature.

In the drawings:

FIG. 1 is a front elevational view of a storage and shipping unit made in accordance with my present invention;

FIG. 2 is a side elevational view of said unit;

Figure 7:
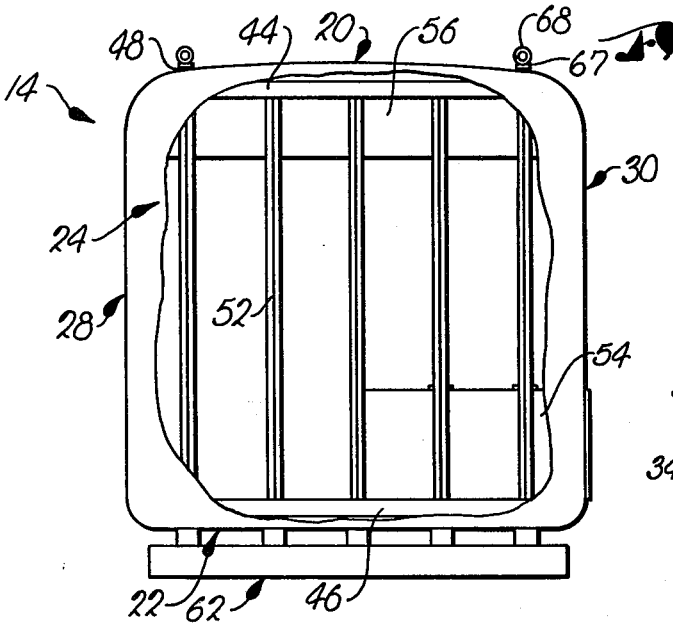
Figure 9:
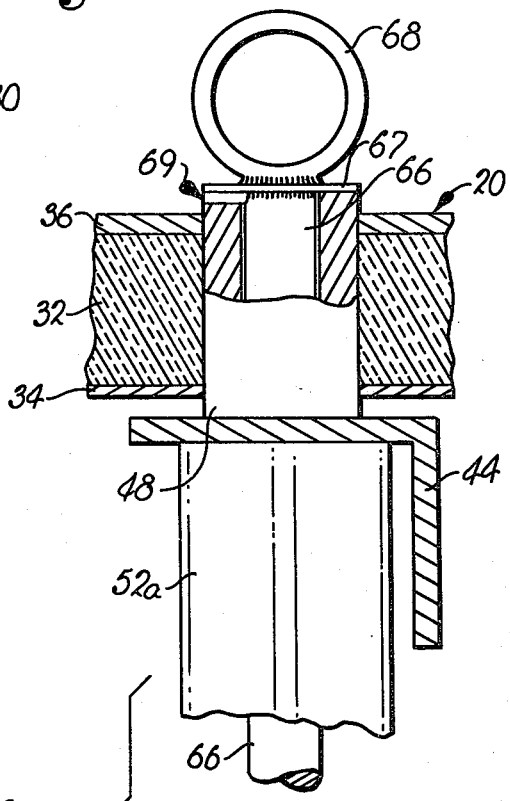
Figure 8:
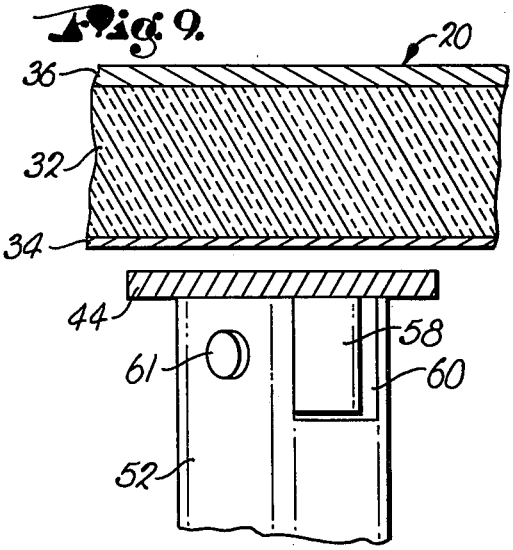
Figure 13:
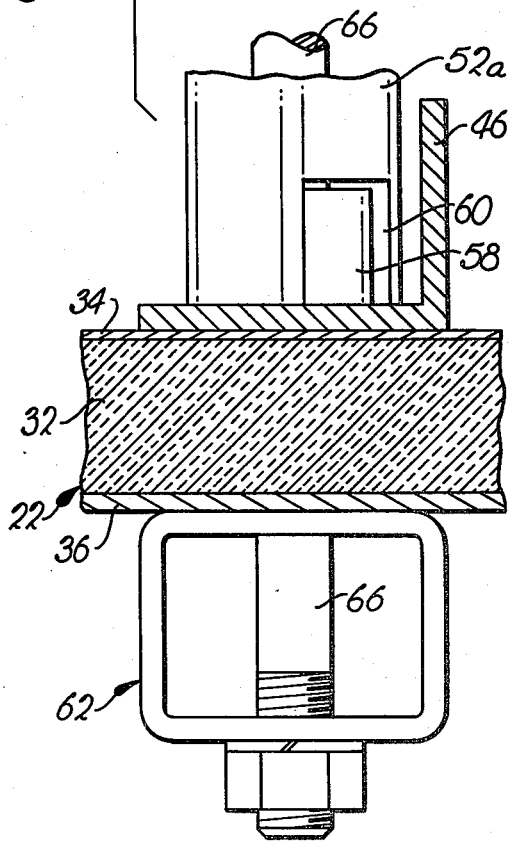
Figure 13:
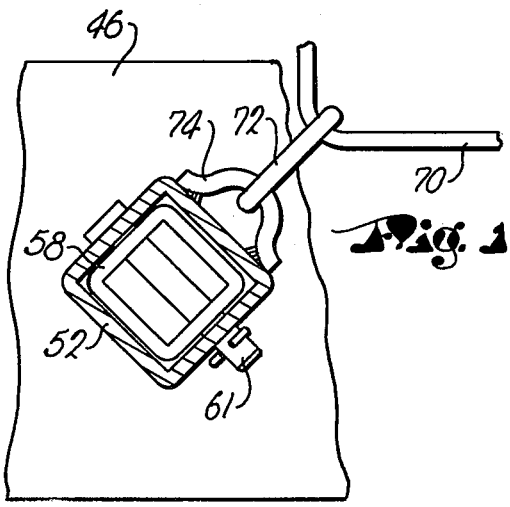
Figure 10:
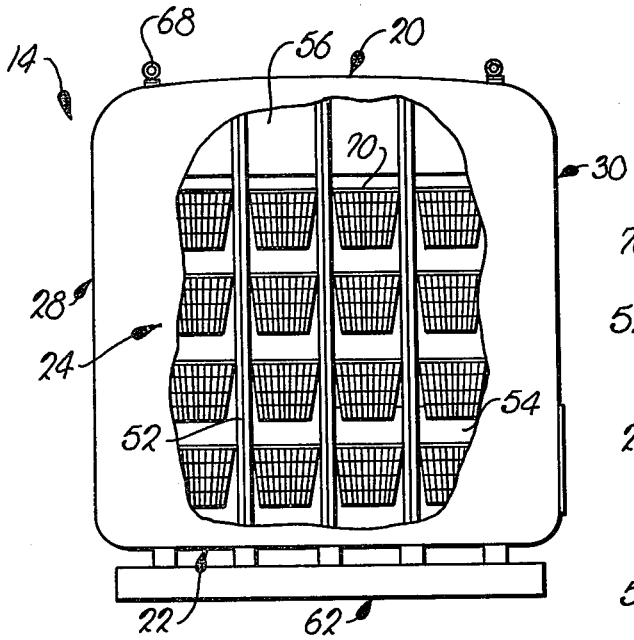
Figure 11:
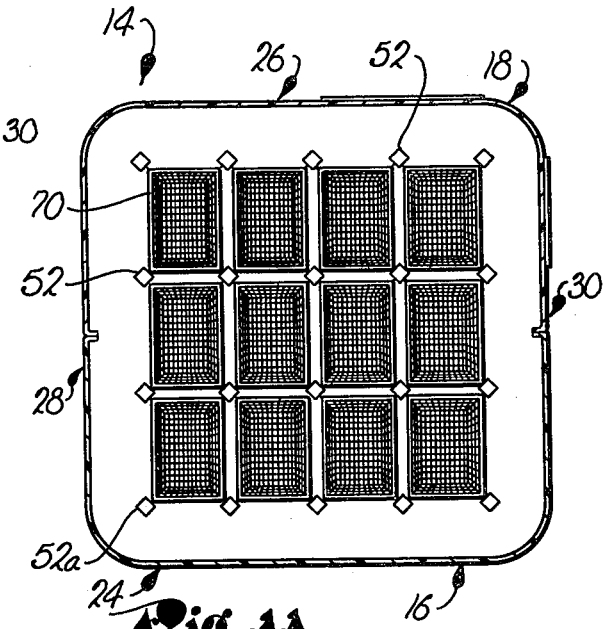
Figure 12:
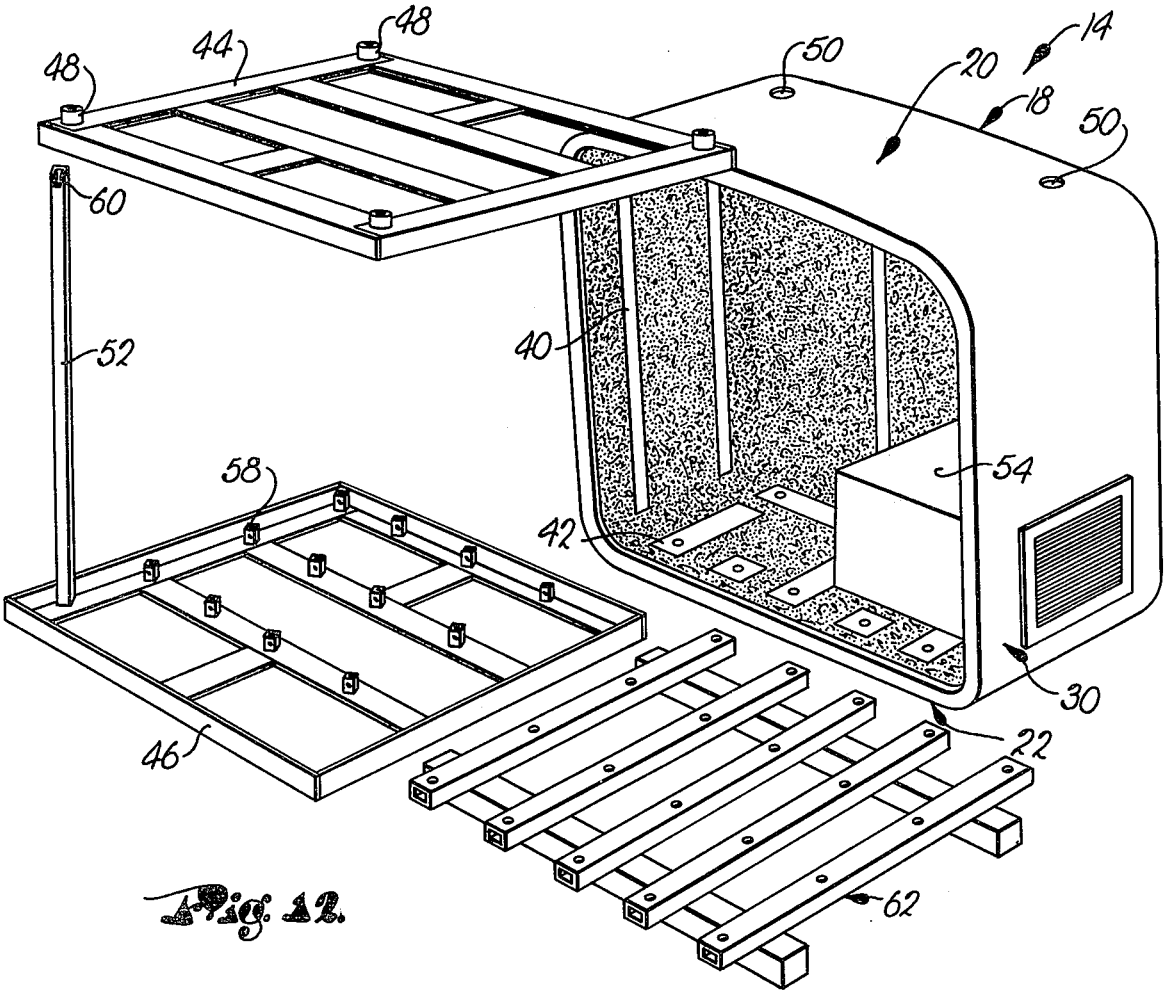

FIGS. 3 and 4 are cross-sectional views taken on lines 3—3 and 4—4 of FIG. 4 respectively;

FIG. 5 is an enlarged cross-sectional view through one of the uprights looking downwardly;

FIG. 6 is a cross-sectional view taken at right angles to FIG. 5;

FIG. 7 is a view similar to FIG. 6, parts being broken away to show details of construction;

FIG. 8 is a fragmentary cross-sectional view showing one of the corner fasteners through an upright, through the upper and lower frameworks, through the top and bottom walls and through the pallet;

FIG. 9 is a fragmentary view, partially in section, showing the releasable connection between the upright and the upper framework;

FIG. 10 is a view similar to FIG. 7 but showing the baskets in place;

FIG. 11 is a horizontal, cross-sectional view through the assembly shown in FIG. 10;

FIG. 12 is a fragmentary, exploded view in perspective showing a portion of the interior of the container and certain components removed therefrom; and FIG. 13 is a detailed, horizontal, cross-sectional view, partially in section, showing a lug-upright connection and a basket-upright connection.

A transportable, walk-in container 14 in the nature of a cooler has a front section 16 and a rear section 18 in abutting relationship as seen in FIGS. 3 and 11, presenting a top wall 20, a bottom wall 22, a front wall 24, a rear wall 26 and a pair of side walls 28 and 30. All of the walls have insulation 32 between an inner and an outer skin 34 and 36 respectively, and an access door 38 forms a part of the wall 24. The upstanding walls 18, 24, 26, 28 and 30 are reinforced by spaced studs 40 and the horizontal walls 20 and 22 are reinforced by spaced, perforated blocks 42 (FIG. 12).

The sections 16 and 18 are tied together by an upper, polygonal support 44 at the skin 34 of the wall 20 and by a lower, polygonal support 46 resting on the skin 34 of the wall 22, both supports 44 and 46 being in the nature of open, skeletal frameworks. The support 44 has an upstanding tube 48 at each of its four corners extending through openings 50 in the wall 20 (FIGS. 8 and 12).

Interposed between the supports 44 and 46 are a series of parallel rows of elongated, spaced apart, parallel uprights 52. The several rows of uprights 52 are, in turn, equally spaced such as to present a number of walk-through passages therebetween, extending from the wall 24 to the wall 26, each equal in height to the distance between the supports 44 and 46 except only for the areas occupied by refrigerator components mounted in the container 14. These include compressor-condensor and evaporator units 54 and 56 respectively, the motors of the compressor and of the condenser being adapted for coupling with a source of electrical energy by a cable (not shown) leading to the outside of the container 14. However, additional uprights 52 may also be provided between the support 44 and the unit 54 as indicated in FIG. 3, as well as between the unit 56 and the support 46, if desired.

Each of the uprights 52 is tubular, presenting open sockets at their ends which receive a plurality of lugs 58 rigid to the supports 44 and 46. Slots 60 are provided in each upright 52 at each of its end sockets rendering the uprights 52 removable upon removal of cross pins 61 shown best in FIG. 13.

A criss-cross pallet 62 beneath the wall 22 is secured to support 46 by a plurality of relatively short fasteners 64, there being a fastener 64 at each lower lug 58 respectively, clamping the wall 22 between the support 46 and the pallet 62 as seen in FIGS. 5 and 6.

The uprights 52 at the four corners of the supports 44 and 46, designated 52*a*, have relatively long fasteners 66 passing therethrough as seen in FIG. 8. The fasteners 66 extend through the tubes 48 and terminate in eyelets 68 above the wall 20. The lower fasteners 66 pass through the supports 44 and 46 as well as through the wall 22 and the pallet 62, and all of the fasteners 64 and 66 pass through the blocks 42.

Plates 67, welded to the eyelets 68, are locked to the tubes 48 at 69, and the tubes 48 are welded to the support 44 to hold the eyelets 68 against rotation. The uprights 52*a* are assembled between the supports 44 and 46, receiving the upper and lower lugs 58 (by virtue of the clearance slots 60) before the fasteners 66 are inserted at the tops of the tubes 48. It is not contemplated that any of the uprights 52 will underlie the unit 56. As shown in FIG. 5, one of the uprights 52 terminates atop the unit 54 and the proximal upright 52*a* and its fastener 66 extend through the unit 54.

A stack of spaced, superimposed receptacles 70, each adapted to receive a quantity of goods to be shipped, stored or used, is disposed in each of the passages formed by the rows of uprights 52, with each receptacle 70 releasably attached to four proximal uprights 52. Each basket 70 is in the nature of an open-top, wire-work basket and each is provided with a swingable hook 72 at each of its four corners (FIG. 13). Each upright 52 has a multitude of hook-receiving loops 74, such that all of the baskets 70 are suspended for free circulation of cool air therearound and therethrough as seen in FIGS. 10 and 11.

OPERATION

The container 14 is readied for receiving the baskets 70 by setting two or more rows of the uprights 52 in place over the upper and lower lugs 58 and locking them against displacement by use of the pins 61. Each basket 70 is then filled with a product or products and carried into the container through the opened door 38. The available passages permit suspension of each basket 70 by placement of its hooks 72 over loops 74 of four uprights 52 and continuing the task until the container is filled, the arrangement being depicted in FIGS. 10 and 11.

In the field, for example, food products may be picked and immediately loaded with the container 14 either preloaded on a truck or other conveyance or picked up after filling. The eyelets 68 may be used for such purpose if a derrick or like implement is available or the pellet 62 employed in connection with a forklift.

When the container 14 is then transported to a dock, warehouse or other receiving facility, the refrigerator may be employed to cool the interior of the container 14 if, for instance, perishable goods have been loaded therein. Subsequently, the containers 14 may be transmitted to ships, trucks or planes for further transport to preselected destinations.

While the unit 14 and its components are especially suitable for storage and/or conveyance of foods directly from the point of harvest, it is not so limited. The suspended baskets 70 will adequately protect numerous types of products, articles, parts and other shippable items without likelihood of damage if only reasonable care is used in handling through use of the pallet 62 and/or the eyelets 68. A suitable lock on the door 38 will lessen the chance of pilferage.

It is not contemplated that the baskets 70 will necessarily always be immediately emptied of their contents and the container 14 returned to its point of reuse. It can also be used as a storage facility for long or short periods or, in some instances, become a somewhat permanent building, workshop or means to protect certain equipment in use, as for example, electrical components of television relay stations at various locations throughout the country. Hence, my invention is not limited to a portable walk-in cooler; the refrigerator components might be entirely eliminated, and receptacles other than wire baskets 70 employed to meet multitudes of needs and products.

I claim:

1. For shipping and storage of goods,
a transportable, walk-in container having top, bottom and upstanding walls;
an access door in one of said walls;
a series of parallel rows of elongated, spaced apart, parallel uprights in said container,
said rows being equally spaced, presenting a number of walk-through passages therebetween;
a stack of spaced, superimposed receptacles in each passage respectively,
each receptacle being adapted to receive a quantity of said goods;
releasable means attaching the receptacles to proximal uprights,
said container having a rear section and a front section;
an upper and a lower support in the container; and
a number of fasteners extending through the top wall, the supports and the bottom wall for holding the sections in abutting relationship, the uprights spanning the distance between the supports, each fastener having an upright in surrounding relationship thereto.

2. For shipping and storage of goods,
a transportable, walk-in container having top, bottom and upstanding walls;
an access door in one of said walls;
a series of parallel rows of elongated, spaced apart, parallel uprights in said container,
said rows being equally spaced, presenting a number of walk-through passages therebetween;
a stack of spaced, superimposed receptacles in each passage respectively,
each receptacle being adapted to receive a quantity of said goods;
releasable means attaching the receptacles to proximal uprights;
an upper and a lower framework in said container; and
means attaching the ends of the uprights to the frameworks.

3. The invention of claim 2; a pallet beneath the bottom wall, presenting means for lifting and handling the container during transport; and a plurality of fasteners clamping the bottom wall between the lower framework and the pallet.

4. For shipping and storage of goods,
a transportable, walk-in container having top, bottom and upstanding walls;
an access door in one of said walls;
a series of parallel rows of elongated, spaced apart, parallel uprights in said container,
said rows being equally spaced, presenting a number of walk-through passages therebetween;
a stack of spaced, superimposed receptacles in each passage respectively,
each receptacle being adapted to receive a quantity of said goods;
releasable means attaching the receptacles to proximal uprights;
an upper support in the container below the top wall and above the uprights;
a lower support in the container above the bottom wall and below the uprights; and
a plurality of lugs secured to the upper and to the lower support, said uprights having lug-receiving sockets.

5. The invention of claim 4, the uprights being slotted for rendering the same removable from the lugs.

6. The invention of claim 5; and removable cross pins through the uprights and through the lugs.

7. For shipping and storage of goods,
a transportable, walk-in container having top, bottom and upstanding walls;
an access door in one of said walls;
a series of parallel rows of elongated, spaced apart, parallel uprights in said container,
said rows being equally spaced, presenting a number of walk-through passages therebetween;
a stack of spaced, superimposed receptacles in each passage respectively, each receptacle being adapted to receive a quantity of said goods;

releasable means attaching the receptacles to proximal uprights;

an upper support for said uprights in the container adjacent said top wall;

a lower support for said uprights in the container adjacent said bottom wall; and a number of fasteners extending through the top wall, the supports and the bottom wall.

8. The invention of claim 7, certain of said uprights surrounding the fasteners.

9. The invention of claim 7, each of said fasteners having an eyelet above the top wall, presenting means for lifting and handling the container during transport.

10. The invention of claim 7; and a pallet connected to said fasteners beneath the bottom wall, presenting means for lifting and handling the container during transport.

* * * * *